United States Patent [19]

Sugiyama

[11] 4,364,996

[45] Dec. 21, 1982

[54] SYNTHETIC FIBERS HAVING DOWN/FEATHER-LIKE CHARACTERISTICS AND SUITABLE FOR WADDING

[75] Inventor: Hiroshige Sugiyama, Otsu, Japan

[73] Assignee: Toyo Boseki Kabushiki Kaisha, Osaka, Japan

[21] Appl. No.: 268,035

[22] Filed: May 28, 1981

[30] Foreign Application Priority Data

May 29, 1980 [JP] Japan ..... 55-72268

[51] Int. Cl.[3] ..... D01F 6/62

[52] U.S. Cl. ..... 428/369; 264/177 F; 428/376; 428/397; 428/398; 428/400

[58] Field of Search ..... 428/369, 376, 397, 398, 428/400; 264/177 F

[56] References Cited

U.S. PATENT DOCUMENTS

| | | | |
|---|---|---|---|
| 3,078,544 | 2/1963 | Shealy | 428/369 |
| 3,131,428 | 5/1964 | Mika | 264/177 F |
| 3,340,571 | 9/1967 | Bishop et al. | 428/397 |
| 3,600,491 | 8/1971 | Shimoda et al. | 428/397 |
| 3,920,784 | 11/1975 | Nakagawa et al. | 428/369 |
| 3,985,934 | 10/1976 | Farrissey et al. | 428/400 |
| 4,129,675 | 12/1978 | Scott | 428/369 |
| 4,176,211 | 11/1979 | Jackson | 264/177 F |
| 4,265,849 | 5/1981 | Borenstein | 264/177 F |

FOREIGN PATENT DOCUMENTS

| | | | |
|---|---|---|---|
| 276550 | 11/1964 | Australia | 428/398 |
| 1369851 | 10/1974 | United Kingdom | 428/369 |

*Primary Examiner*—James C. Cannon

*Attorney, Agent, or Firm*—Jones, Tullar & Cooper

[57] ABSTRACT

A synthetic fiber for wadding which has a plurality of projections in its cross section and a section deformation ratio (S) of not less than $5000/\sqrt{D}$ (wherein D is a monofiber denier) and which has the following physical characteristics:

Monofiber denier (D, denier): 0.1 to 3;

Coefficient of inter-fiber static friction ($\mu_s$): not more than 0.14;

Crimp number (CN, number/25 mm): 4 to 14;

Ratio of crimp index and crimp number (Ci(%)/CN): 0.6 to 1.8;

$H_{0.2}$ (cm): not less than 7.3;

$H_{0.2}/H_{25}$ (cm/cm): not less than 6.5;

$\delta_D$ (g/cm$^2$/cm): not more than 0.4.

4 Claims, 5 Drawing Figures

Figure 1A:
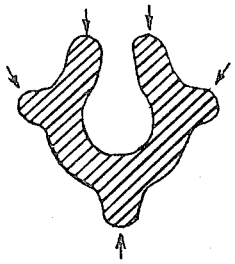
Figure 1B:
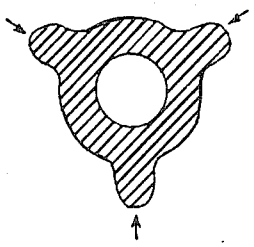
Figure 1C:
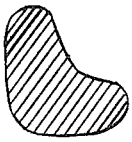
Figure 1D:
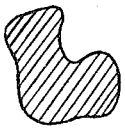

SYNTHETIC FIBERS HAVING DOWN/FEATHER-LIKE CHARACTERISTICS AND SUITABLE FOR WADDING

The present invention relates to synthetic fibers having characteristics similar to down/feathers in bulkiness, draping, feeling, recoverability, heat insulation, etc. and suitable for wadding in bedclothes, quilting clothes, etc.

Bedclothes, quilting clothes and the like comprising down/feathers as the wadding are widely used in the world due to favorable characteristics in bulkiness, draping, feeling, recoverability, heat insulation, etc. However, those are relatively expensive, because down/feathers can be obtained only from limited sources such as waterfowls (e.g. ducks, geese) and must be processed through many steps including collection, selection, disinfection, degreasing, etc.

On the other hand, various attempts for imparting down/feather-like characteristics to synthetic fibers have been made. For instance, Japanese Patent Publication (examined) Nos. 28426/77 and 50308/77 disclose a process for modification of synthetic fibers by applying a silicone oil thereto. This process is effective in improvement of draping, but the resulting product is insufficient in bulkiness and has a different feeling from down/feathers. In addition, it is inferior in recoverability after compression. Further, for instance, Japanese Patent Publication (examined) Nos. 7955/73 and 39134/76 disclose a process for making the collection state of synthetic fibers spherical or radial. Thus, this process can afford special forms of fibers, which however do not have any similar characteristics to down/feathers.

As a result of the extensive study for producing wadding provided with down/feather-like characteristics, it has been found that the use of fine denier synthetic fibers having certain specific crimping characteristics is effective in enhancing bulkiness. It has also been found that draping is highly improved by lowering the coefficient of inter-fiber static friction (which is hereinafter referred to as "$\mu_s$") in addition to keeping the fibers thin or fine. It has further been found that the feeling of down/feathers is characterized by a remarkably low stress under compression in a region of extremely low load and is attained by making fibers fine and keeping the $\mu_s$ value low. Furthermore, it has been found that although the high recoverability after compression of down/feathers is mainly due to their shapes and such shapes can not be realized by the use of synthetic fibers, the maintenance of the $\mu_s$ value at a lower level can make the recoverability of synthetic fibers closer to that of down/feathers. On the basis of these findings, the present invention provides synthetic fibers which have down/feather-like characteristics and are suitable for wadding.

The synthetic fibers of this invention have the following physical characteristics:

Monofiber denier (D, denier): 0.1 to 3;

Coefficient of inter-fiber static friction ($\mu_s$): not more than 0.14;

Crimp number (CN, number/25 mm): 4 to 14;

Ratio of crimp index and crip number (Ci(%)/CN): 0.6 to 1.8;

$H_{0.2}$ (cm): not less than 7.3;

$H_{0.2}/H_{25}$ (cm/cm): not less than 6.5;

$\delta_D$ (g/cm$^2$/cm): not more than 0.4.

The synthetic fibers of this invention may be made of polyolefins, polyamides, acrylic fibers, polyesters, etc. Among them, polyethylene terephthalate is the most preferable, because of its excellent physical characteristics.

The first requirement for the physical characteristics of the synthetic fibers of the invention is to have a monofiber denier of 0.1 to 3. In order to attain favorable bulkiness, draping and feeling, the monofiber denier is preferred to be not more than 3. When, however, it is less than 0.1 denier, the recoverability after compression becomes inferior due to the tangling of fibers. Particularly when the $\mu_s$ value is low, the fibers are apt to percolate the woven cloth of which a bag comprising such fibers is made, and they are not suitable for the practical use. The favorable range of the monofiber denier is from 0.6 to 1.4. In this connection, it may be noted that conventional synthetic fibers for wadding have a monofiber denier of more than 4, particularly of more than 6.

The $\mu_s$ value indicates the one determined by the Röder method. It is required to be not more than 0.14, preferably not more than 0.12; otherwise the resulting product is inferior in draping and feeling. For lowering the $\mu_s$ value below the said upper limit, there may be adopted a process wherein the unstretched tow is immersed in a silicone oil bath, stretched and then subjected to heat treatment, a process wherein the stretched tow is applied with an excessive amount of silicone oil and then compressed, for instance, by the aid of a nip roller to eliminate the excessive silicone oil, a process wherein the crimped tow is applied with an excessive amount of silicone oil and then compressed to eliminate the excessive silicone oil, a process wherein the tow is cut in short, applied with an excessive amount of silicone oil and then compressed to eliminate the excessive silicone oil, etc. In any event, silicone oil is uniformly applied onto synthetic fibers, and the synthetic fibers are then heat treated until the silicone oil is cross-linked to an appropriate extent. Examples of the silicone oil are dimethylpolysiloxane, hydrogenmethylpolysiloxane, aminopolysiloxane, epoxypolysiloxane, etc. These may be used alone or, if necessary, with other siloxanes insofar as the $\mu_s$ value is made not more than 0.14. When desired, a dispersing agent may be incorporated therein to assure the uniform attachment onto the fibers. Also, a catalyst may be incorporated therein to achieve the cross-linking rapidly. The silicone oil may be used as such or in an aqueous emulsion state.

The sole adoption of making fibers fine or keeping the $\mu_s$ value low is not suitable for the use as wadding, because the product is inferior in bulkiness. To make the bulkiness satisfactory, the crimping characteristics must be within a certain specific range. Namely, the product having a crimp number (CN) of less than 4 is less bulky because there are too few crimps, and the product having a crimp number of more than 14 is also less bulky because the crimp amplitude is too low. Thus, a suitable crimp number is from 4 to 14. Further, the crimp index (Ci) is required to be in an appropriate ratio to CN. When the ratio is too low, a sufficient bulkiness will not be attained. When the ratio is too high, draping and feeling will become inferior. In general, the Ci/CN ratio should be from 0.6 to 1.8.

The fibers having the above crimping characteristics will give the maximum bulkiness and the best feeling when subjected to web-formation by the use of a garnett such as a roller card. When the fibers are too fine, their ability to pass through the card is deteriorated. Particularly when the fibers are less than 2 denier, normal opening will be difficult to achieve unless a special card is used. Even if the opening could be accomplished, tangling is poor due to the low $\mu_s$ value so that normal web-formation only can be achieved with great difficulty. In order to avoid this problem, the fibers are required to have certain specific characteristics in cross section, i.e. a plurality of projections in cross section as shown in FIG. 1 (*a*) and (*b*) of the accompanying drawings (wherein the projections are indicated by an arrow mark) and a section deformation ratio of not less than $5000/\sqrt{D}$ (wherein D is the monofiber denier). When the above requirements are met, the fibers show a low $\mu_s$ value and are satisfactorily self-opening without application of any opening operation thereto. Particularly when the said crimping characteristics are provided, such fibers possess good self-opening property. The self-opening property is especially remarkable when the cross section forms substantially a U-letter shape as shown in FIG. 1 (*a*). Such self-opening property is produced even when three dimensional crimped fibers such as side-by-side type composite fibers and potentially crimping fibers produced by the asymmetrically cooling spinning method, etc. For the fibers having a modified cross section as stated above and a three dimensional crimping property, any opening operation such as card opening is substantially unnecessary.

Still, the said section deformation ratio (S) may be calculated according to the following equation:

$$S = \frac{\text{Circumference of cross section of fiber (cm)}}{\text{Area of cross section of fiber (cm}^2\text{)}}$$

(Note: in case of the fiber being hollow, the circumference of cross section indicates the outer circumference.)

The synthetic fibers of this invention have satisfactory characteristics for the use as wadding in bedclothes, quilting clothes, etc. with or without opening by the aid of any conventional garnett. Such characteristics are normally provided in the synthetic fibers having the physical constants as hereinafter explained.

In general, the goods comprising down/feathers or down/feather-like materials receive quilt processing. In case of a bedcloth, for instance, the goods are divided into small sections, 30 cm×40 cm, and wadding is filled in each section. In this invention, such a process was performed in the following manner:

Two sheets of woven cloth ("Downproof" ® manufactured by Toyo Boseki K.K.; using 40 English type count of cotton yarn for warp and weft; weaving density, 120 yarns/inch×110 yarns/inch; air permeability according to the flange seal method (JIS L1004), 1.0 ml/cm$^2$.sec) were stitched up to make a bag of 30 cm×40 cm having an opening at the one side. Fibers (48 g) were packed in the bag, the opening of the bag was stitched and the entire surface of the bag was beaten repeatedly and sufficiently to make a pillow sample having a uniform thickness.

Using the pillow sample as prepared above, the following values were measured:

$H_{0.2}$: On the pillow sample, a metal plate of 30 cm×40 cm weighing 240 g was placed softly and exactly. After 1 minute, the height ($H_{0.2}$, cm) of the pillow sample was measured.

$H_{25}$: On the pillow sample, a metal plate of 30 cm×40 cm weighing 30 kg was placed softly and exactly. After 1 minute, the height ($H_{25}$, cm) of the pillow sample was measured.

$\delta_D$: Compression test was made on the central portion of the pillow sample by the use of a compression tester ("TENSILON UMT-IIIL" manufactured by Toyo-Baldwin K.K.). Compression was carried out by the use of a compression plate of 150 mm in diameter at a rate of 50 mm/min. From the resulting compression length-stress pattern (chart speed, 50 cm/min; full scale, 10 g/cm$^2$), the $\delta_D$ value was calculated according to the following equation:

$$\delta_D = \frac{0.2 - 0.1}{h_{0.2} - h_{0.1}} \text{ (g/cm}^2\text{/cm)}$$

wherein $h_{0.1}$ and $h_{0.2}$ are respectively the compression lengths (cm) under a stress of 0.1 g/cm$^2$ and of 0.2 g/cm$^2$.

The bulkiness, which is one of the characteristics for the products comprising down/feathers, is expressed by the height ($H_{0.2}$) under a low load of 0.2 g/cm$^2$. Down/feathers of good quality, i.e. ones having a larger mixing percentage of the so-called "down", show a $H_{0.2}$ value of not less than 7.3 cm. Draping is expressed by $H_{0.2}/H_{25}$, of which a higher value indicates better draping. The $H_{0.2}/H_{25}$ value of down/feathers of good quality is more than 6.5. The feel and hand of a down/feather product is characterized by its low stress under compression ($\delta_D$) in a region of low load (0.1 to 0.2 g/cm$^2$), and the $\delta_D$ value of the down/feathers of good quality is less than 0.4 g/cm$^2$/cm.

The fiber length of the synthetic fiber of the invention is not limiting, and it may be usually from 20 to 70 mm when opening is effected by the use of an opening machine such as a roller card. Alternatively, the synthetic fiber may be used in a long fiber state.

It is most preferred to use the synthetic fibers of the invention for wadding without being admixed with any other fiber. However, other synthetic fibers, chemical fibers, natural fibers, down/feather, etc. may be admixed with the synthetic fibers of the invention to such an extent that the favorable characteristics of the synthetic fibers of the invention are practically maintained. In order to charge the synthetic fibers in a cut fiber form into bags to make bedclothes, quilting clothes and the like, the blowing method with air is recommended.

Practical and presently preferred embodiments of the invention are illustratively shown in the following examples.

EXAMPLE 1

Figure 2:
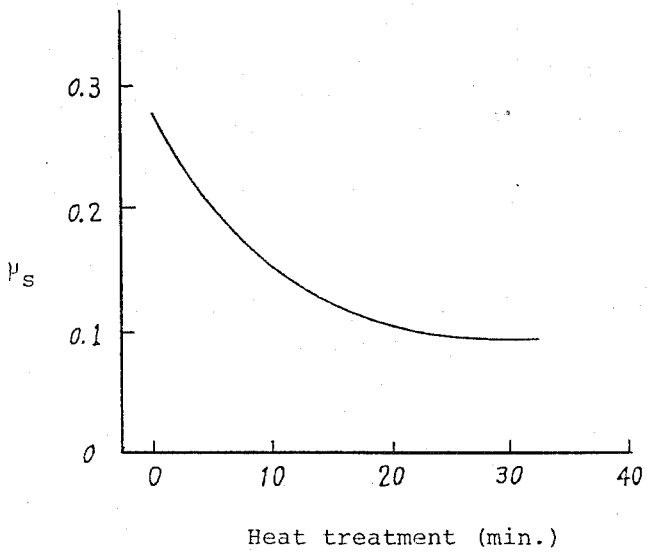

Polyethylene terephthalate having an intrinsic viscosity of 0.62 (determined in a mixed solvent of phenol and tetrachloroethane (6:4 by weight) at 30° C.) was melt spun through an orifice having round spinning holes according to a conventional procedure, and the resulting filaments were stretched in a two state, crimped in a stuffing box under appropriate conditions to obtain desired crimping characteristics and subjected to heat treatment at 160° C. for 5 minutes. The spinning and stretching conditions were varied depending on the desired monofiber denier. The tow after heat treatment was immersed in a 5% aqueous emulsion of α,ω-bis(-trimethylsiloxy)-polydimethylsiloxane-methylhydrogensiloxane copolymer (viscosity at 25° C., 15,000 centipoise) and compressed by the aid of a nip roller to eliminate excessive emulsion. Then, the resulting tow was subjected to heat treatment at 145° C. and cut in 33 mm long. Depending on each tow, the time for heat treatment was varied so as to modify the coefficient of inter-fiber friction coefficient. (The relationship between the heat treatment time and the $\mu_s$ value is shown in FIG. 2.) The deniner, crimping characteristics and friction coefficient of the thus obtained fibers are shown in Table 1.

The above prepared cut fiber was passed through a conventional roller card and charged into a bag made of "Downproof" ® with suction to make a pillow sample comprising the cut fiber (48 g). The values $H_{0.2}$, $H_{0.2}/H_{25}$ and $\delta_D$ of the sample were determined and shown in Table 1 wherein the data for down/feathers are also given.

TABLE 1

| Sample No. | D (denier) | CN (number/25 mm) | Ci (%) | Ci/CN | $\mu_s$ | $H_{0.2}$ (cm) | $H_{0.2}/H_{25}$ (−) | $\delta_D$ (g/cm²/cm) |
|---|---|---|---|---|---|---|---|---|
| 1 | 0.08 | 4.8 | 4.5 | 0.94 | 0.11 | 10.0 | 13.3 | 0.26 |
| 2 | 0.20 | 6.3 | 7.3 | 1.16 | 0.14 | 9.7 | 7.2 | 0.28 |
| 3 | 0.20 | 5.8 | 7.2 | 1.24 | 0.09 | 8.9 | 10.6 | 0.26 |
| 4 | 1.2 | 9.1 | 6.0 | 0.66 | 0.14 | 8.2 | 7.2 | 0.34 |
| 5 | 1.2 | 7.9 | 6.8 | 0.86 | 0.09 | 7.9 | 12.3 | 0.32 |
| 6 | 1.2 | 3.8 | 4.6 | 1.21 | 0.10 | 6.9 | 5.8 | 0.39 |
| 7 | 1.2 | 5.7 | 10.4 | 1.82 | 0.12 | 8.2 | 6.1 | 0.45 |
| 8 | 1.2 | 14.7 | 19.1 | 1.30 | 0.09 | 7.0 | 9.2 | 0.42 |
| 9 | 1.2 | 9.8 | 5.7 | 0.58 | 0.09 | 6.3 | 7.9 | 0.37 |
| 10 | 1.2 | 9.2 | 6.0 | 0.65 | 0.15 | 7.5 | 6.4 | 0.38 |
| 11 | 3.0 | 8.7 | 12.4 | 1.43 | 0.14 | 7.4 | 6.8 | 0.39 |
| 12 | 3.0 | 8.5 | 12.5 | 1.47 | 0.09 | 7.3 | 10.0 | 0.38 |
| 13 | 3.2 | 7.9 | 8.2 | 1.04 | 0.10 | 7.1 | 6.5 | 0.42 |
| Down 100% | | | | | | 10.3 | 13.6 | 0.33 |
| Down 20%/feathers 80% | | | | | | 7.3 | 6.5 | 0.40 |

Note:

Sample No. 1 is excellent in bulkiness, feeling and draping. However, it produces much percolated fibers even when the cloth for the bag has a low air permeability of 1.0 ml/cm².sec.

From the above results, it is understood that the fibers according to this invention (Sample Nos. 2 to 5, 11 and 12) have favorable characteristics like down/feathers. The one having a monofiber denier of less than 0.1 (Sample No. 1) produces much percolated fibers and is practically not usable. The ones having a CN value of less than 4 (Sample No. 6) or of more than 14 (Sample No. 8) are poor in bulkiness. The one having a Ci/CN ratio of more than 1.8 (Sample No. 7) is inferior in feeling and draping, and the one having a Ci/CN ratio of less than 0.6 (Sample No. 9) is inferior in bulkiness. The one having a $\mu_s$ value of more than 0.14 (Sample No. 10) is inferior in draping, and the one of more than 3 denier (Sample No. 13) is inferior in bulkiness and feeling.

EXAMPLE 2

Using the same polymer as in Example 1, there were prepared fibers having a cross section as shown in FIG. 1 (*a*) and possessing a monofiber denier (D) of 1.2, 2.0 or 3.0. The fibers were obtained by spinning the polymer according to the asymmetrical cooling method, stretching the resultant filament in a dry state at 160° C., cutting the stretched filament in 28 mm long, subjecting the cut fibers to heat treatment at 150° C. for 30 minutes and imparting three dimensional crimp to the heat treated fibers. The fibers were spray-oiled with epoxypolysiloxane and aminopolysiloxane in two steps so as to attach thereto each of the siloxanes in an amount of 0.2% by weight. The $\mu_s$ value was in a range of 0.08 to 0.09.

The fibers of this Example had a self-opening property due to the effect of the modified cross section shape, particularly the effect of the projections, even immediately after stretching. Therefore, even when it was filled in a bag without application of any opening operation, the favorable characteristics as shown in Table 2 were produced.

TABLE 2

| Sample No. | D (denier) | CN (number/25 mm) | Ci (%) | Ci/CN | $\mu_s$ | $H_{0.2}$ (cm) | $H_{0.2}/H_{25}$ (−) | $\delta_D$ (g/cm²/cm) | Section deformation ratio (S) (cm⁻¹) |
|---|---|---|---|---|---|---|---|---|---|
| 14 | 1.2 | 8.3 | 7.9 | 0.95 | 0.08 | 9.7 | 11.3 | 0.29 | 4940 |
| 15 | 2.0 | 9.0 | 10.2 | 1.13 | 0.09 | 8.8 | 10.6 | 0.32 | 3630 |
| 16 | 3.0 | 6.2 | 10.8 | 1.74 | 0.08 | 9.3 | 10.7 | 0.38 | 3070 |

EXAMPLE 3

The fibers were prepared under the same conditions as applied for preparation of the one (Sample No. 15) in Example 2. In this Example, however, the application of the oily preparations and the heat treatment were carried out onto the stretched tow in a long filament state without cutting, and the resulting long filaments were as such charged in a bag. The results are shown in Table 3.

TABLE 3

| Sample No. | D (denier) | CN (number/25 mm) | Ci (%) | Ci/CN | $\mu_s$ | $H_{0.2}$ (cm) | $H_{0.2}/H_{25}$ (−) | $\delta_D$ (g/cm²/cm) | Section deformation ratio (S) (cm⁻¹) |
|---|---|---|---|---|---|---|---|---|---|
| 17 | 2.0 | 8.6 | 8.7 | 1.01 | 0.11 | 9.2 | 10.3 | 0.28 | 3630 |

As understood from the above results, the synthetic fibers of this invention show favorable characteristics even when employed in a long fiber state.

EXAMPLE 4

Using as the polymer polytetramethylene terephthalate having an intrinsic viscosity of 0.81 (hereinafter referred to as "PBT"), polycyclohexylenedimethylene terephthalate having an intrinsic viscosity of 1.05 (hereinafter referred to as "PCHDT") or polycaprolactam having a relative viscosity of 2.5 when determined in 98% sulfuric acid at 30° C. (hereinafter referred to as "NY"), a fiber having a monofiber denier of about 2 was prepared in the same manner as in Example 2.

The characteristics of the fibers and of the pillow sample obtained by packing such fibers into a bag without any opening operation are shown in Table 4.

TABLE 4

| Sample No. | Kind of polymer | D (denier) | CN (number/ 25 mm) | Ci (%) | Ci/CN | $\mu_s$ | $H_{0.2}$ (cm) | $H_{0.2}/H_{25}$ (–) | $\delta_D$ (g/cm²/cm) |
|---|---|---|---|---|---|---|---|---|---|
| 18 | PBT | 2.0 | 7.6 | 8.0 | 1.05 | 0.08 | 8.6 | 8.2 | 0.32 |
| 19 | PCHDT | 2.0 | 8.7 | 10.3 | 1.18 | 0.10 | 10.1 | 9.6 | 0.28 |
| 20 | Ny | 1.8 | 5.1 | 5.2 | 1.02 | 0.07 | 7.3 | 7.0 | 0.38 |

EXAMPLE 5

Using the same polymer as in Example 1, a fiber having a cross section shape as shown in FIG. 1 (*c*) or (*d*) and possessing a monofiber denier of 2 was prepared under the same conditions as in Example 2. The characteristics of the fibers are shown in Table 5.

TABLE 5

| Sample No. | CN (number/ 25 mm) | Ci (%) | Ci/CN | $\mu_s$ | $H_{0.2}$ (cm) | $H_{0.2}/H_{25}$ (–) | $\delta_D$ (g/cm²/cm) | Section deformation ratio (S) (cm⁻¹) |
|---|---|---|---|---|---|---|---|---|
| 21 | 6.3 | 7.2 | 1.14 | 0.10 | 6.3 | 5.6 | 0.38 | 3480 ($4920/\sqrt{D}$) |
| 22 | 5.9 | 7.0 | 1.19 | 0.10 | 7.4 | 6.6 | 0.29 | 3630 ($5130/\sqrt{D}$) |

As understood from the above results, the fibers having a section deformation ratio of less than $5000/\sqrt{D}$ (Sample No. 21) has low self-opening property and, when packed in a bag, shows a small $H_{0.2}$ value. The fibers having a section deformation ratio of not less than $5000/\sqrt{D}$ (Sample No. 22) has good self-opening property and, when packed in a bag, shows favorable characteristics.

What is claimed is:

1. A synthetic fiber for wadding which has a plurality of projections in its cross section and a section deformation ratio (S) of not less than $5000/\sqrt{D}$ (wherein D is a monofiber denier) and which has the following physical characteristics:

Monofiber denier (D, denier): 0.1 to 3;

Coefficient of inter-fiber static friction ($\mu_s$): not more than 0.14;

Crimp number (CN, number/25 mm): 4 to 14;

Ratio of crimp index and crimp number (Ci(%)/CN): 0.6 to 1.8;

$H_{0.2}$(cm): not less than 7.3;

$H_{0.2}/H_{25}$ (cm/cm): not less than 6.5;

$\delta_D$ (g/cm²/cm): not more than 0.4.

2. The synthetic fiber according to claim 1, which has a crimped shape produced by its potential crimping property.

3. The synthetic fiber according to claim 1, which is made of a polyester comprising repeating units of ethylene terephthalate as the major component.

4. The synthetic fiber according to claim 1, which has substantially a U-letter shape in its cross section.

* * * * *